United States Patent [19]

Erdman, Jr. et al.

[11] Patent Number: 4,750,274

[45] Date of Patent: Jun. 14, 1988

[54] SLUDGE PROCESSING

[75] Inventors: Andrew Erdman, Jr., Colorado Springs, Colo.; Jeffrey C. Johnson, Birmingham, Mich.; Jerry A. Levad, Colorado Springs, Colo.

[73] Assignees: Joy Manufacturing Co., Pittsburgh, Pa.; Haden Schweitzer Corp., Madison Heights, Mich.

[21] Appl. No.: 7,156

[22] Filed: Jan. 27, 1987

[51] Int. Cl.[4] ..... F26B 15/10

[52] U.S. Cl. ..... 34/39; 34/182; 34/183; 34/180; 432/214; 432/215

[58] Field of Search ..... 34/180, 183, 182, 39; 432/214, 215

[56] References Cited

U.S. PATENT DOCUMENTS

| | | | |
|---|---|---|---|
| 3,775,041 | 11/1973 | Buttner | 432/215 |
| 3,776,774 | 12/1973 | Miller . | |
| 3,800,865 | 4/1974 | Onarheim et al. | 34/183 |
| 3,808,701 | 5/1974 | Bachmann . | |
| 4,193,206 | 3/1980 | Maffet . | |
| 4,579,596 | 4/1986 | Murzyn . | |

*Primary Examiner*—Larry I. Schwartz
*Attorney, Agent, or Firm*—Edward L. Levine

[57] ABSTRACT

Methods for continuous drying of sludges. Large scouring particles are added to a sludge to be dried to create a mixture which is passed through a rotary screw type indirect heat exchanger. The scouring particles are large relative to the particulates of suspended and dissolved solids which result from drying in the heat exchanger. During the process of drying and conveying the mixture through the heat exchanger the scouring particles continuously remove the particulate residue from the surfaces of the heat exchanger. It also appears that the particles assist in the actual heat transfer between the heat exchanger surfaces and the sludge by absorbing and subsequently releasing heat through relatively large surface areas. The scouring particles can be consumptive, that is, consumed in processes during subsequent handling of the residue, or nonconsumptive. In the nonconsumptive case, upon discharge from the heat exchanger the scouring particles are separated from the particulate residue and recycled for mixing again with the sludge.

18 Claims, 2 Drawing Sheets

SLUDGE PROCESSING

BACKGROUND OF THE INVENTION

This invention relates to methods for drying sludges and more particularly provides methods for continuous drying of sludges in rotary screw type indirect heat exchangers.

Drying of sludges is a common process in numerous applications. Examples ranges from the treatment of wastes such as paint sludge, to the drying of blood cells, to the recovery of ores, to the processing of foodstuff, among many other applications. The degree of drying also can encompass a wide range, for example, from the volumetric reduction of a sludge for use in subsequent process steps or disposal to a more complete drying resulting in a dry particulate product.

A common occurrence in the drying process, particularly where a substantial degree of drying is desired, is the caking of particulate matter on the surfaces of the heat exchanger. Caking oftentimes occurs in the drying of sludges in rotary screw type material conveying heat exchangers. The caking is often so complete as to make the conveyor appear as a cylinder or log, completely stopping the conveying action. Thus, caking requires that the process be shut down and the heat exchanger cleaned prior to continuation of drying. This batch type operation is costly and time consuming. Further, the methods and tools used to clean the heat exchanger can cause damage or excessive wear.

Many different structures and processes have been used for cleaning of the caked material from the heat exchanger surfaces. In some cases the surfaces, presenting a screw type profile on a central shaft, have been scraped manually with special tools or abrasive materials. This is very time consuming. In other cases the process is stopped and a scouring particulate material, such as rock salt, has been placed into the caked unit and run through the unit to abrasively remove the caked material from the heat transfer surfaces. These processes, while an improvement over manual scrapping, still require periodic shutdown of the sludge drying process and continuation only on a batch by batch basis.

In some systems, complex mechanical devices have been used to perform a mechanical wiping of the heat transfer surfaces simultaneously with the drying process. Such systems are complex and prone to failure, and still tend to require periodic shutdown for ultimate cleaning. An example of a mechanical cleaning structure is given in U.S. Pat. No. 3,808,701. There, a drying unit includes a central rotor having a helical band and also scraping and wiping elements which extend to within a close clearance of the inner containing wall. The wiping and scraping elements engage agglomerates which form on the wall to remove them. Although this configuration helps to provide a more uniform product, there remains a likelihood of caking of the material on the helical band.

Another mechanical configuration includes dual "self-cleaning" screws so closely oriented so as to scrape buildup from the heat exchange surfaces of the adjacent screw. The critical nature of the spacing makes such units costly to fabricate.

A process for cleaning conduits, including heat exchanger tubes, is described in U.S. Pat. No. 4,579,596. A nonagglomerating drying agent is concurrently mixed with cleaning particles entrained in a carrying fluid.

The mixture, in a stated improvement of the Sandjet process, is introduced into a conduit at a high velocity to achieve desired cleaning. A similar mixture could be used to clean a helical screw heat exchanger having caked product on its surfaces. A primary limitation of such system is, however, the requirement that the operation be interrupted to perform the cleaning.

A somewhat similar cleaning method proposed for cleaning extruders is described in U.S. Pat. No. 3,776,774. In that teaching, two polymers are inserted into the barrel of an extruder. One is particularly brittle and is crushed in the extruder barrel, tending to clean the inside of the barrel. The second polymer melts at a lower temperature than the crushed material and, after melting, helps to remove the crushed polymer and loosened deposits from the extruder barrel. While similar materials could also be used with a screw type indirect heat exchanger, they still require periodic interruption of the drying process in order to perform the cleaning.

U.S. Pat. No. 4,193,206 describes a process for drying sewage sludge. One embodiment of that teaching uses a rotating helical screw conveyor element surrounded by a porous wall which functions as a mechanical dewatering zone for the sludge. A plasticizer material is added to the sludge being processed. Also added to the sludge is a stream of recycled dry solids. The admixture of the plasticizer and the dry material with the incoming wet sludge helps to provide a product stream with a desired bulk density that is more readily processed in an extruder. The recycled product is comprised of the fine solids contained in the sludge material. Undesirable product buildup can also occur on units operated in this manner.

It is therefore desirable to provide a method for operating screw type indirect heat exchangers which alleviates limitations caused by caking. It is particularly desirable to provide methods which eliminate the need for complex mechanical structures. It is also desirable to provide methods which allow for increased operating time. Particularly useful are methods which avoid caking and/or which allow continuous removal of any caked materials. It is further desirable to provide operating and/or cleaning processes which do not add undesirable materials to the dried product material where an uncontaminated product is required. It is also desirable to provide sludge drying methods which add flexibility to the control of the rate of drying and other related process parameters.

SUMMARY OF THE INVENTION

This invention provides methods for the drying of sludges in indirect heat exchangers, which methods significantly alleviate or eliminate prior caking related limitations. In a preferred embodiment a sludge to be dried to powder form is passed through a dual screw type indirect heat exchanger. Mixed with the sludge, however, are large particles of a scouring material. The scouring particles are large relative to the size of the dired particulates from the sludge. This generally means scouring particles on the order of one quarter inch and larger. The scouring particles, unless frangible, are smaller than the clearances between the heat exchange surfaces and between the surfaces and the containing housing.

The mixture is discharged from the heat exchanger, and then is separated into the particulate product and the scouring particles. Alternatively, this discharge can be directed to ultimate disposal or further processing of another type. In some instances, all or part of the discharge can be recycled for another pass through the heat exchanger. In the exemplary instance where the particulate product and scouring particles are separated, the scouring particles are recycled for mixing with further sludge entering the heat exchanger. The large scouring particles function to continually scour the heat exchange surfaces and prevent undesirable cracking. It is also believed that the large particles aid in the heat transfer process, further tending to lessen the likelihood that particles will cake on the heat exchange surfaces.

In other embodiments large frangible particles are mixed with a sludge to be dewatered or dried in a dual screw indirect heat exchanger. The frangible particles can be larger than the component clearances and function to scour the heat exchange surfaces as they break apart. Additionally, the frangible material selected can be one which is compatible with processing of the dried sludge after discharge from the heat exchanger. For example, frangible coal mixed with a waste sludge can produce a product useful as a fuel.

BRIEF DESCRIPTION OF THE DRAWINGS

The advantages, nature and additional features of the invention will become more apparent from review of the following description, taken in connection with the accompanying drawings, in which.

DESCRIPTION OF THE PREFERRED EMBODIMENTS

Figure 1:
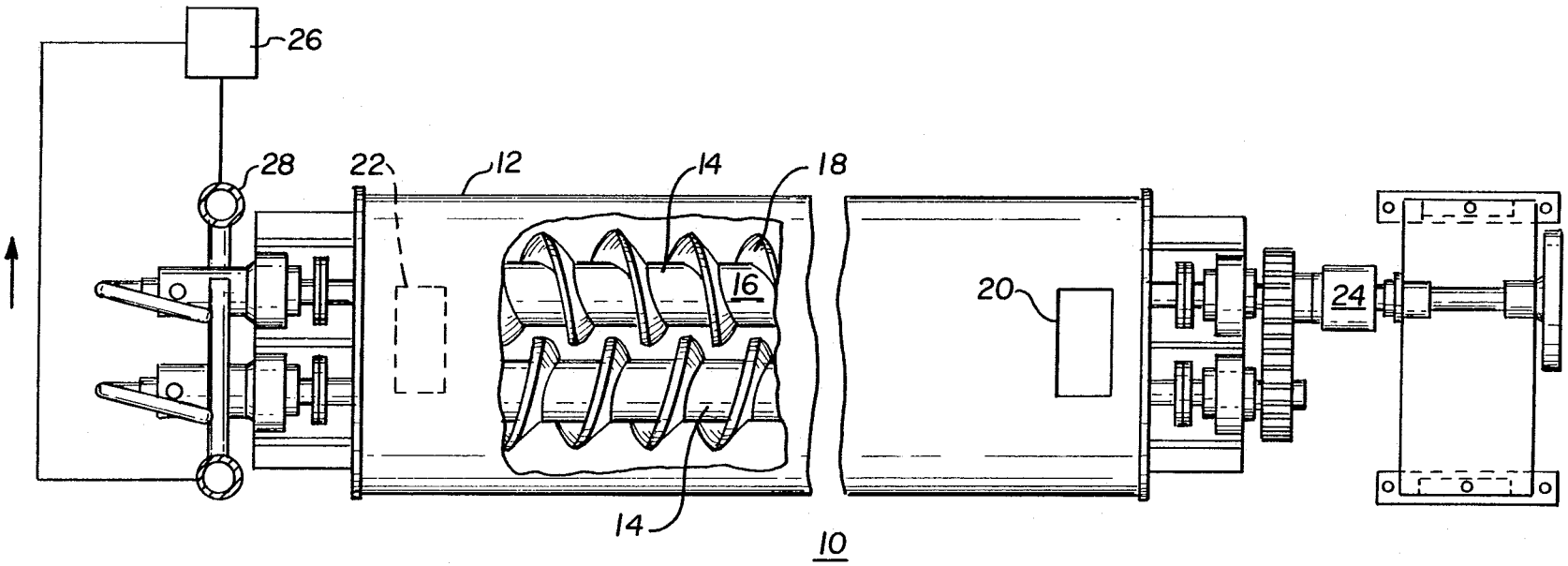
FIG. 1 is a top view of a dual screw indirect heat exchanger of the type useful in connection with practice of the inventive process.

Referring now to FIG. 1 there is shown one type of indirect heat exchanger 10. The heat exchanger 10 includes a housing 12 within which are rotatably supported two conveyors or screws 14. The screws 14 each comprise a central shaft 16 supporting hollow flights 18. The housing 12 has a top inlet 20 and a bottom outlet 22. A motor and gear assembly 24 rotates the screws 14. A fluid source 26 supplies a heat exchange fluid to a distribution conduit 28 which directs the fluid through the hollow flights 18. The fluid returns through the center of the shaft 16 and is directed back to the source 26. An exemplary rotary processor of this type is disclosed in U.S. Pat. No. 3,529,661. Although the invention is disclosed with specific reference to the illustrated dual flight rotary heat exchanger, it will be recognized that the process is useful in connection with single screw or multiple screw systems having more than two flights, as well as similar types of dryers.

Figure 2:
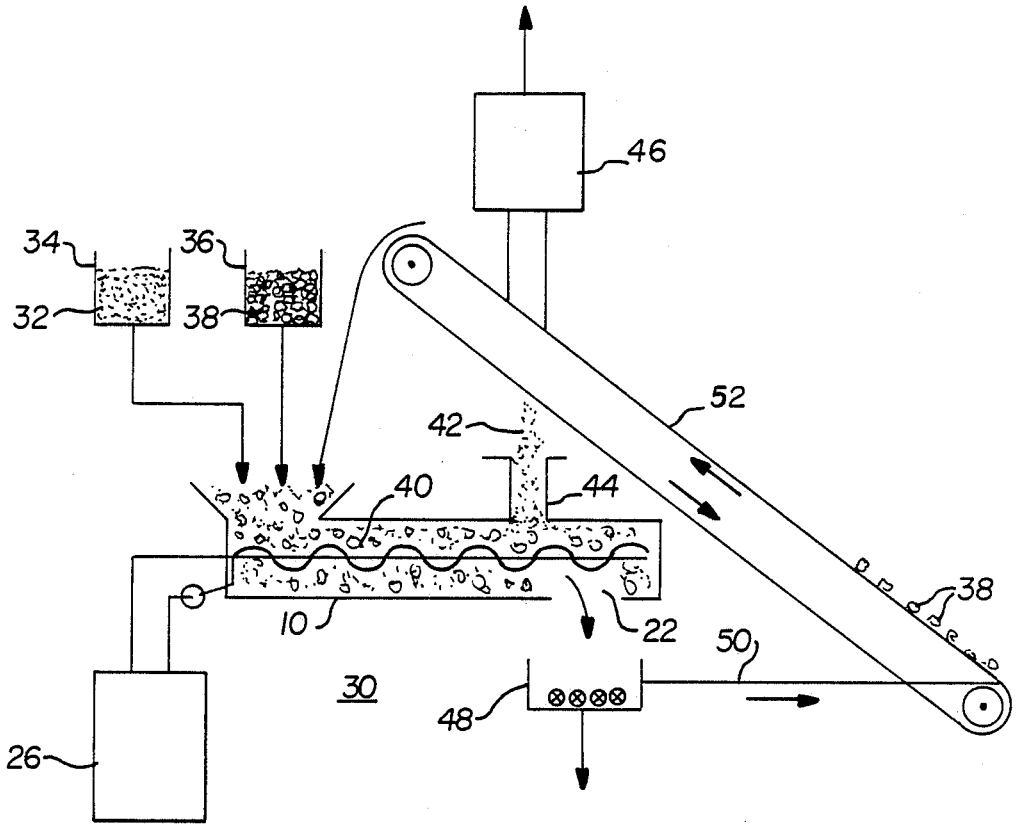
FIG. 2 is a simplified schematic of an operating system which may be used in carrying out the process.

Referring now to FIG. 2 there is shown an exemplary sludge processing system 30. A sludge is fed from a container 34 into the indirect heat exchanger 10. Another container 30 contains large scouring particles 38 which are mixed with the sludge 32 to form a mixture 40. The mixture 40 is passed through the heat exchanger 10 during which passage it is volumetrically reduced through evaporation of volatiles 42. The volatiles 42 are discharged through an outlet 44 and can be further treated in a volatile processing system 46.

The dried mixture 40 is discharged from the heat exchanger through outlet 22 into a separator 48. In the separator 48 the large scouring particles 38 are separated from the balance of the mixture, typically being a dry powdery sized particulate, and are recycled to the container 36 or directly into the heat exchanger 10. A recycle conduit 50 and other means for transferring particles such as a screw conveyor or a moving belt 52, represent one structure for recycling of the large particles 38 back to the mixture 40 and the incoming sludge 32.

There are innumerable types of sludges. Sludges can be organic, or inorganic. Sludges typically include both dissolved solids and suspended solids in a volatile liquid. Volatile herein refers to the carrrier liquid to be driven from the sludge during passage through the heat exchanger. The most typical volatile is water. Other example volatiles are naphtha or other hydrocarbons which are used as solvents or which have been mixed with solids such as a soil during an accidental spill.

The dictionary definition of sludge includes: (1) mud, mire, a muddy deposit; ooze, (2) a muddy or slushy mass, deposit or sediment; as (a) the precipitated solid matter produced by water and sewage treatment processes; (b) mud from a drill hole in boring; (c) muddy sediment in a steam boiler; (d) (1) slime, (2) waste, from a coal washery; (e) a precipitate or settling from oils; especially one (as a mixture of impurities and acid) from mineral oils (as petroleum refined by sulfuric acid or oxidized); (3) a clump of agglutinated red blood cells. A sludge as used herein refers to these types of materials and others having dissolved or suspended solid particulates in a volatile liquid.

Particulates, as used herein, refers to solid particulates dissolved or suspended in the liquid, which when dried and removed from the liquid are small, that is, powder like or sand like in size. Sludges formed of particulates which are greater than sand like in size tend not to cake up on the heat exchangers. Sludges formed of small particulates do tend to cake up, and it is toward these that the invention is directed. Small means generally no larger than about 28 mesh and more often no larger than 65 mesh. Small herein is also used relative to the term large which describes the size of the scouring particles. The large scouring particles are substantially larger than the particulates of the sludge. Large generally means orders of magnitude larger than the particulates of the sludge, and generally greater than about one-quarter inch in one dimension, and more often greater than about three-eighths of an inch. The large scouring particles can be spherical, but are more useful in irregular shapes. Substantially larger particles are also those of a size which scour, rather than cake upon the heat transfer surfaces of the heat exchanger when drying a given sludge.

Figure 3:
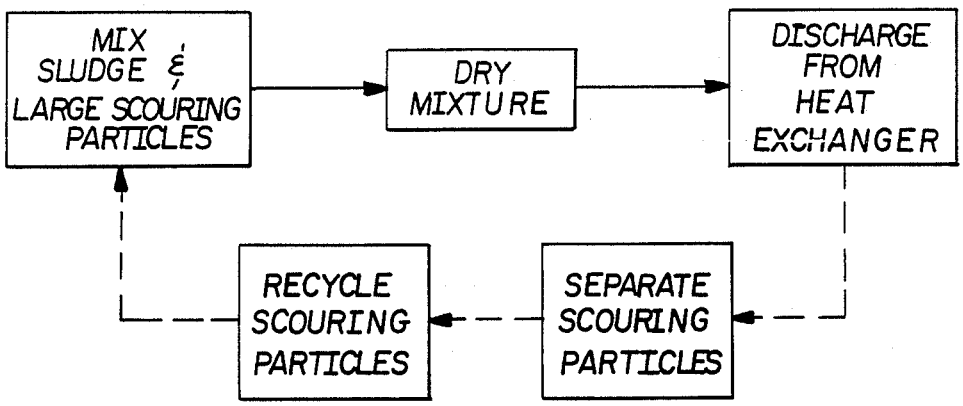
FIG. 3 is a block diagram of selected steps of the inventive process.

The subject process, in one embodiment, comprises several steps in connection with the handling of sludge, including (1) adding large scouring particles to the sludge to create a mixture, (a) passing the mixture through a rotating indirect heat exchanger so as to drive volatiles from the mixture while scouring particulates from the heat exchange surfaces, and (3) discharging the dried product particulates and large scouring particles from the heat exchanger. In some applications additional steps are particularly useful, including (4) separating the product particulates and the scouring particles and (5) recycling the scouring particles to the sludge. The process with these additional steps is represented in FIG. 3. It will also be recognized that the discharge from a given pass through the heat exchanger can, if desired be completely or partially recycled for an additional pass. Most applications are contemplated for a single pass of the sludge.

The following examples describe laboratory tests on exemplary sludges. The primary purpose of the tests was to demonstrate the feasibility of use of large scouring particles with different sludge types. The complete accuracy of the recorded data was secondary and experimental error in the taking of the data is considered to be on the order of ±20%. Comparison among the tests indicates some of the beneficial results associated with use of large scouring particles in connection with the disclosed process. The tests were performed on a model D-333-1/2 dual helical screw conveyor/heat exchanger marketed by the Joy Manufacturing Company, Pittsburgh, Penn. The specifications of the test unit include:

No. of screws: 2
O.D. of screws: 3 inches
Pitch: 1½ inches
Screw material: 316 stainless steel
Heat transfer area, screws: 4.7 sq. ft.
Theoretical conveying capacity: 0.4 cfh/rpm
Housing volume: 0.27 cu. ft.

In performing the tests, each constituent was weighed and premixed before being fed into the test unit. The tests were performed by continuously feeding the test material into the unit and maintaining plug flow at all times. The test material was maintained in the housing at a level that completely covered the dual screws. The test unit was located beneath a fume hood with a fan operating during the test. Three sludges were used:

Sludge #1: Paint booth sludge—85% water, 15% clay, paint solids and organic solvents;

Sludge #2: Industrial and domestic chemical sewage sludge—75% water, 25% waste solids of ⅓ primary clarifier underflow and ⅔ secondary clarifier underflow dewatered in a centrifuge;

Sludge #3: chemical type waste, 86% water, 4% naphtha, 10% clay soil.

Prior to utilization of the inventive process, attempts to dry each of these sludges in heated screw conveyors had failed. Failure was caused by the tendency of the wet sludge solids to buildup and coat the helix surfaces. As the solids build up, heat transfer is impaired and conveyance is reduced. Ultimately the conveyor will not receive or convey any more material. This failure is referred to as "logging" in that the volume between the flights fills with material and the screws appear as a log. Runs defined as "1-" "2-" and "3-" refer respectively to sludge #1, #2 and #3.

Table I presents the test results. Run 1-A, 1-B was a single test on the sludge #1 itself, without added scouring particles. 1-B was a second pass through the heat exchanger of the discharge from 1-A. The run ended with significant caking and scale formation on the screw.

Run 1-C through 1-F was made on samples of premixed paint sludge and scouring particles of extra course rock salt in a weight ratio of 1:1. The rock salt was from a ¾"×¼" mesh. Some of the rock salt dissolved into the sludge/scouring particle mixture during the test. No scale or caking formed on the screws. 1-C through 1-F were consecutive passes of the discharge. This is generally akin to a single pass through a conveyor unit which is four times as long as the test unit.

Run 1-G through 1-J was made on a sample of premixed paint sludge and scouring particles of pea gravel (aquarium gravel). The pea gravel was from a 6×10 mesh (particles approximately ⅛ inch in diameter). Although no scale or caking formed on the screws, overall heat transfer decreased significantly from the previous run with larger particles. 1-G through 1-J were consecutive passes of the discharge.

Run L was made on a sample of premixed paint sludge and −20 mesh sand (particles approximately 0.0165 inches in diameter) in a weight ratio of 1:1. The sand particles were not large enough to effectively scour and the run ended with caking and scale formation on the middle quarter of the screws. It is to be recognized that reference to the term diameter throughout the disclosure is intended to cover the mean diameter of particles which are not necessarily spherical.

Run M was a repeat of Run L using a premixed sample of sludge and additional sand particles added to the wet feed in a weight ratio of 1:3. The run was better than Run L in that it ran longer with less caking, but eventually failed by caking at the front ten percent of the screws.

Run 2-N, 2-O was made on a sample of the premixed chemical sewage sludge (#2) and coal. The sludge was mixed in a weight ratio of 1:1 with ¾"×¼" crushed coal. Because the coal is friable, the run was successful. The sludge was dried to 0.46% (substantially dry) in the two passes. Run 2-P through 2-Q was similar. It will be recognized that the dry product, including the scouring coal particles, could be used for example as a fuel.

Run 3-R, 3-S was made on a sample of the premixed chemical type waste and scouring particles of volcanic rock. The sludge was mixed in a 1:1 ratio by volume with volcanic rock from a 1"×¼" mesh. This is equivalent to a weight ratio of 70% sludge to 30% volcanic rock since the rock density was considerably less than that of the test material. R was the first pass and S was a second pass. This test was successful and no fouling occurred.

The test results show that a wide variety of materials can be used for the large scouring particles. However, the size of the particles is critical in preventing logging up of the conveyor. Minus 20 mesh sand, for example, is too small, even at a high solids ratio of 3:1 sand to sludge. Both generally unbreakable materials such as pea gravel, and friable materials such as rock salt, coal and volcanic rock, can be used.

It is believed that the large particles not only act as a device to physically scour the surface of the screws, but also as a heat transfer intermediary between the screws and the sludge. This appears to be particularly the case where large volumetric reductions of volatiles occur as when drying high water content sludges. Additionally, the large scouring particles also function to de-lump semi-dried solids during the drying and conveying process. Often in conventional processing lumps having wet centers and dry exteriors are fumed. The large scouring particles continually interact with clumps to break them and expose the centers, which further enchances the drying process.

It will now be apparent that use of large scouring particles allows continuous processing of sludges that otherwise could not be achieved in an indirect conveying type heat exchanger. It will also be apparent that many alternatives to the specific exemplary embodiments are possible. The method can be used with or without separation and recycle of the large particles discharged from the heat exchanger. Mixing of the scouring particles and the lsludge can occur upstream of the heat exchanger, or at the front end of the heat exchange itself.

The type of scouring particle, the size of the particle and the recycle ratio are each adjustable over a range of applications. The type of particle is almost limitless, although the selected particle should be compatible with the particular sludge being processed. For example, a sludge for human or animal consumption, such as spent grain from a brewery, requires a particle that will not leave a toxic residue in the dried product. Stainless steel or hard ceramic materials are particular candidates. Organic materials, and odd shaped materials are also useful. For example, corn cobs or walnut shells may be used. Nut shells are particularly beneficial for abrasion. More than one scouring particle can be used. For example, a primarily organic waste sludge can be mixed with corn cobs and coal particles to provide a dry compost for burning.

Particle size can be limited at the upper end by the clearances or pinch point spacing between the screws or the screws and the housing. If hard, nonfriable particles are used, that is, particles that can damage the heat exchange surface if squeezed at a pinch point, the particles must be sized smaller than the clearances. Friable materials are not so limited. At the lower end, particles larger than minus 20 mesh sand are required, and preferably particles approximately one eighth to one quarter inch minimum diameter are utilized. Although it some applications smaller particles could be used and would bring about a dry product without caking on the screws, extremely high recycle ratios would be required. The preferred range for the recycle ratio, the ratio by weight of scouring particles to sludge in the mixture, is between approximately 0.5:1 to 2:1. A ratio greater than about 2:1 does not process enough sludge at a feasible rate, much of the processing and conveyance going into the scouring particles. A weight ratio smaller than about 0.5:1 or a volume ratio less than about 1:1 tends to log the screw due to insufficient scouring action.

It will be appreciated that in addition to use for drying of sludges, the larger scouring particle process is useful in connection with other chemical processes. For example, processes involving the mixing of materials to create a specific reaction or mixture wherein the scouring particles are consumed, function as a catalyst, or merely provide desired mechanical flow properties. Other examples include simple heating or cooling of flowable materials which are, at least at some temperatures, inherently gluey or sticky or which undergo sticky phase changes. Another example is the processing or cooking of foods, such as sauces or scrambled eggs.

For best operation in a screw drier, it will also be apparent that the mixture must fill the housing trough at least up to the level of the central shaft. Otherwise, the abrasive scouring action only takes place along the outer periphery of the screws. A caking buildup would occur at the shaft and inner surfaces of the screw flights. It is also to be recognized that the process is useful whether a completely dry product discharge is desired or merely a discharge having a lower volatile concentration than the inlet concentration. Terms such as drying as used herein are intended to cover both complete and partial drying.

Other alternatives are possible without departing from the spirit and scope of the invention. It therefore is intended that the foregoing description be taken as illustrative, and not in a limiting sense.

TABLE I

| Sludge Run | Feed Bulk Density #/Ft.$^3$ | Screw Speed RPM | Feed Rate #/Hr. | Volatile Percent In/Out | Material Temperature (In/Out) °.F | Oil Temperature (In/Out) °F. |
|---|---|---|---|---|---|---|
| 1-A | 61 | 1.4 | 47.8 | 80.0/34.4 | 80/201 | 403/392 |
| 1-B | 41 | 1.4 | 28.0 | 34.0/17.6 | 160/201 | 403/396 |
| 1-C | | 4 | 144 | 51.9/32.8 | 80/201 | 403/385 |
| 1-D | | 4 | 138 | 37.8/19.9 | 180/210 | 403/397 |
| 1-E | | 4 | 126 | 19.9/13.5 | 190/300 | 403/397 |
| 1-F | | 4 | 129 | 13.5/10.2 | 290/350 | 403/401 |
| 1-G | | 4 | 144 | 30.8/17.0 | 85/201 | 403/388 |
| 1-H | | 4 | 148 | 17/7.0 | 190/210 | 403/396 |
| 1-I | | 4 | 136 | 7.0/3.8 | 200/275 | 403/397 |
| 1-J | | 4 | 124 | 3.8/2.3 | 270/330 | 403/398 |
| 1-L | | | Immediate Failure | | | |
| 1-M | | 4 | 99.1 | 18.7/.5 | 87/335 | 567/553 |
| 2-N | | 4 | 59.35 | 75.4/31.5 | 78/175 | 502/482 |
| 2-O | | 4 | 118.7 | Total | | |
| 2-P | | 4 | 16.17 | 31.5/.46 | 170/327 | 502/487 |
| 2-Q | | 4 | 61.8 | Total | | |
| 3-R | | 5.75 | 128 | 90/ | 70/140 | 562/537 |
| 3-S | | 5.75 | 132 | /0 | 120/365 | 560/542 |

We claim:

1. A method of drying a sludge of suspended and dissolved solids in a volatile liquid, comprising:

adding scouring particles to said sludge to create a mixture, said scouring particles having a dimension substantially larger than the diameter of said suspended and dissolved solids;

passing said mixture across a rotary screw type indirect heat exchanger having hollow flights so as to evaporate said volatile liquid from said mixture and create a substantially dry particle product while said scouring particles continuously remove said dry particle product from the surface of said flights;

discharging said evaporated mixture of dry particle product and scouring particles from said heat exchanger;

separating said scouring particles from said dry particle product; and recycling said separated scouring particles for use in said steps of adding scouring particles to said sludge.

2. The method of claim 1 wherein said step of adding scouring particles comprises adding scouring particles having a dimension at least several orders of magnitude larger than the diameter of said suspended and dissolved solids.

3. The method of claim 2 wherein said step of adding scouring particles comprises adding scouring particles having a dimension larger than about one quarter inch.

4. The method of claim 1 wherein said step of adding scouring particles comprises creating a sludge to particle weight ratio mixture of 0.5:1 to 2:1.

5. The method of claim 1 wherein said step of adding scouring particles comprises creating a sludge to particle volume ratio mixture of approximately 1:1.

6. The method of claim 1 wherein at least a portion of said dry particle product is recycled with said separated scouring particles.

7. A method of drying a sludge having suspended and dissolved solids in a volatile liquid using a twin screw type rotary heat exchanger having a clearance between the twin screws, comprising:

adding frangible scouring bodies to said sludge to create a mixture, said scouring bodies being larger than said clearance;

flowing said mixture through said heat exchanger so as to evaporate at least some of said volatile liquid from said mixture and create a substantially dry particle product while said scouring bodies break and continuously remove said dry particle produce from the surface of said twin screws; and discharging said evaporated mixture of dry particle product and scouring bodies from said heat exchanger.

8. The method of claim 7 wherein said step of adding frangible scouring bodies comprises adding a solid fossil fuel to said sludge.

9. A method of drying a sludge having suspended and dissolved solids in a volatile liquid, comprising:

adding scouring particles to said sludge to create a mixture, said scouring particles being of a size substantially larger than said suspended and dissolved solids;

passing said mixture across a rotary conveyor type indirect heat exchanger having hollow flights so as to evaporate some of said volatile liquid from said mixture and create a substantially reduced volume product while said scouring particles continuously remove said reduced volume product from the surface of said flights;

discharging said evaporated mixture of reduced volume product and scouring particles from said heat exchanger;

separating said scouring particles from said reduced volume product; and recycling said separated scouring particles for use in said step of adding scouring particles to said sludge.

10. The method of claim 9 wherein at least a portion of said reduced volume product is recycled with said separated scouring particles.

11. A method of drying a sludge having suspended and dissolved solids in a volatile liquid, comprising:

adding scouring particles to said sludge to create a mixture, said scouring particles having a mean diameter substantially larger than the mean diameter of said suspended and dissolved solids;

passing said mixture across a rotary conveyor type indirect heat exchanger having hollow flights so as to evaporate some of said volatile liquid from said mixture and create a substantially higher solids concentration product while said scouring particles continuously remove said higher solids concentration product from the surface of said flights; and discharging said evaporated mixture of a higher solids concentration product and scouring particles from said heat exchanger.

12. A method of drying a sludge having suspended and dissolved solids in a volatile liquid, comprising:

adding scouring particles to said sludge to create a mixture, said scouring particles having a mean diameter substantially larger than the mean diameter of said suspended and dissolved solids;

passing said mixture across a rotary screw type indirect heat exchanger having hollow flights so as to evaporate some of said volatile liquid from said mixture and create a substantially higher solids concentration product while said scouring particles continuously remove said higher solids concentration product from the surface of said flights;

discharging said evaporated mixture of a higher solids concentration product and scouring particles from said heat exchanger;

separating said scouring particles from said higher solids concentration product; and recycling said separating scouring particles for use in said step of adding scouring particles to said sludge.

13. A method of drying a sludge including suspended or dissolved solids in a volatile liquid to form a dry particulate product, said method comprising the steps of:

adding scouring particles to said sludge to create a mixture, said scouring particles having a size larger than that of the particles comprising said particulate product;

passing said mixture through a conveying type indirect heat exchanger having moving heat transfer surfaces so as to evaporate said volatile liquid from said mixture and create said particulate product while said scouring particles simultaneously remove caked particulate product from said heat transfer surfaces;

discharging said mixture of particulate product and scouring particles from said heat exchanger;

separating at least a portion of said scouring particles from said particulate product; and recycling said separated portion of said scouring particles for reuse in said step of adding scouring particles to said sludge.

14. The method of claim 13 wherein at least a portion of said particulate product is also recycled with said separated portion of said scouring particles.

15. The method of claim 13 wherein said step of adding scouring particles comprises adding scouring particles having a dimension at least several orders of magnitude larger than the diameter of said suspended or dissolved solids.

16. The method of claim 15 wherein said step of adding scouring particles comprises adding scouring particles having a dimension larger than about one quarter inch.

17. The method of claim 13 wherein said step of adding scouring particles comprises creating a sludge to particle weight ratio mixture of 0.5:1 to 2:1.

18. The method of claim 13 wherein said step of adding scouring particles comprises creating a sludge to particle volume ratio mixture of approximately 1:1.

* * * * *